US009711878B2

(12) United States Patent
Zhang

(10) Patent No.: US 9,711,878 B2
(45) Date of Patent: Jul. 18, 2017

(54) POWER CONNECTOR HAVING A STRONG CONTACT

(71) Applicant: FOXCONN INTERCONNECT TECHNOLOGY LIMITED, Grand Cayman (KY)

(72) Inventor: Jian-Li Zhang, HuaiAn (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 15/135,571

(22) Filed: Apr. 22, 2016

(65) Prior Publication Data

US 2016/0315404 A1 Oct. 27, 2016

(30) Foreign Application Priority Data

Apr. 22, 2015 (CN) ..... 2015 2 0246294 U

(51) Int. Cl.

| | |
|---|---|
| ***H01R 13/40*** | (2006.01) |
| ***H01R 24/00*** | (2011.01) |
| ***H01R 12/70*** | (2011.01) |
| ***H01R 13/428*** | (2006.01) |
| ***H01R 13/24*** | (2006.01) |
| *H01R 13/41* | (2006.01) |

(52) U.S. Cl.

CPC ..... *H01R 12/7088* (2013.01); *H01R 13/2407* (2013.01); *H01R 13/2428* (2013.01); *H01R 13/2478* (2013.01); *H01R 13/2492* (2013.01); *H01R 13/428* (2013.01); *H01R 13/2464* (2013.01); *H01R 13/41* (2013.01)

(58) Field of Classification Search

CPC ..... H01R 12/7088; H01R 13/2407; H01R 13/2492; H01R 13/2478

USPC ..... 439/700, 630, 591

See application file for complete search history.

(56) References Cited

U.S. PATENT DOCUMENTS

| | | | | |
|---|---|---|---|---|
| 4,773,877 A * | 9/1988 | Kruger | ..... | H01R 13/2428 439/700 |
| 7,527,532 B2 * | 5/2009 | Northey | ..... | H01R 13/2428 439/700 |
| 7,607,952 B2 | 10/2009 | Tai | | |
| 7,775,804 B2 * | 8/2010 | Neidich | ..... | H01R 13/2428 439/700 |

(Continued)

FOREIGN PATENT DOCUMENTS

CN 203119151 2/2013

*Primary Examiner* — Felix O Figueroa

(74) *Attorney, Agent, or Firm* — Wei Te Chung; Ming Chieh Chang

(57) ABSTRACT

A power connector includes: an insulative housing having an upper surface, a lower surface, and a receiving space; a number of contacts accommodated in the insulative housing, the contact having a contacting portion, a rear portion accommodated in a rear end of the insulative housing, and a snakelike elastic portion connecting the contacting portion and the rear portion, the snakelike elastic portion having a number of vertical bending sections and a number of connecting sections each connecting every two adjacent bending sections, wherein the vertical dimension of the intersecting surface of the bending section is greater than the vertical dimension of the intersecting surface of the connecting section.

16 Claims, 7 Drawing Sheets

(56) References Cited

U.S. PATENT DOCUMENTS 8,591,270 B1 * 11/2013 Ramsey ..... H01R 13/24
439/700

* cited by examiner

POWER CONNECTOR HAVING A STRONG CONTACT

BACKGROUND OF THE INVENTION

1. Field of the Invention

The present invention relates generally to a power connector, and more particularly to a power connector contact design.

2. Description of Related Arts

China Patent No. 203119151, issued on Aug. 7, 2013, discloses a power connector comprises an insulative housing and a plurality of contacts accommodated in the insulative housing. The contact comprises a wandering elastic portion, a contacting portion extending forwardly from the wandering elastic portion, and a rear portion extending rearward from the wandering elastic portion. The snakelike elastic portion comprises a plurality of bending portions and a plurality portions connecting portions connecting the bending portions. The wandering elastic portion is not strong enough because the width of the bending portion and the width of the connecting portion are same.

A power connector having a strong tensile strength is desired.

SUMMARY OF THE INVENTION

Accordingly, an object of the present invention is to provide a sturdy power connector.

To achieve the above object, a power connector includes: an insulative housing having an upper surface, a lower surface, and a receiving space; a number of contacts accommodated in the insulative housing, the contact having a contacting portion, a rear portion accommodated in a rear end of the insulative housing, and a snakelike elastic portion connecting the contacting portion and the rear portion, the snakelike elastic portion having a number of vertical bending sections and a number of connecting sections each connecting every two adjacent bending sections, wherein the vertical dimension of the intersecting surface of the bending section is greater than the vertical dimension of the intersecting surface of the connecting section.

Other objects, advantages and novel features of the invention will become more apparent from the following detailed description when taken in conjunction with the accompanying drawings.

DETAILED DESCRIPTION OF THE PREFERRED EMBODIMENT

Figure 1:
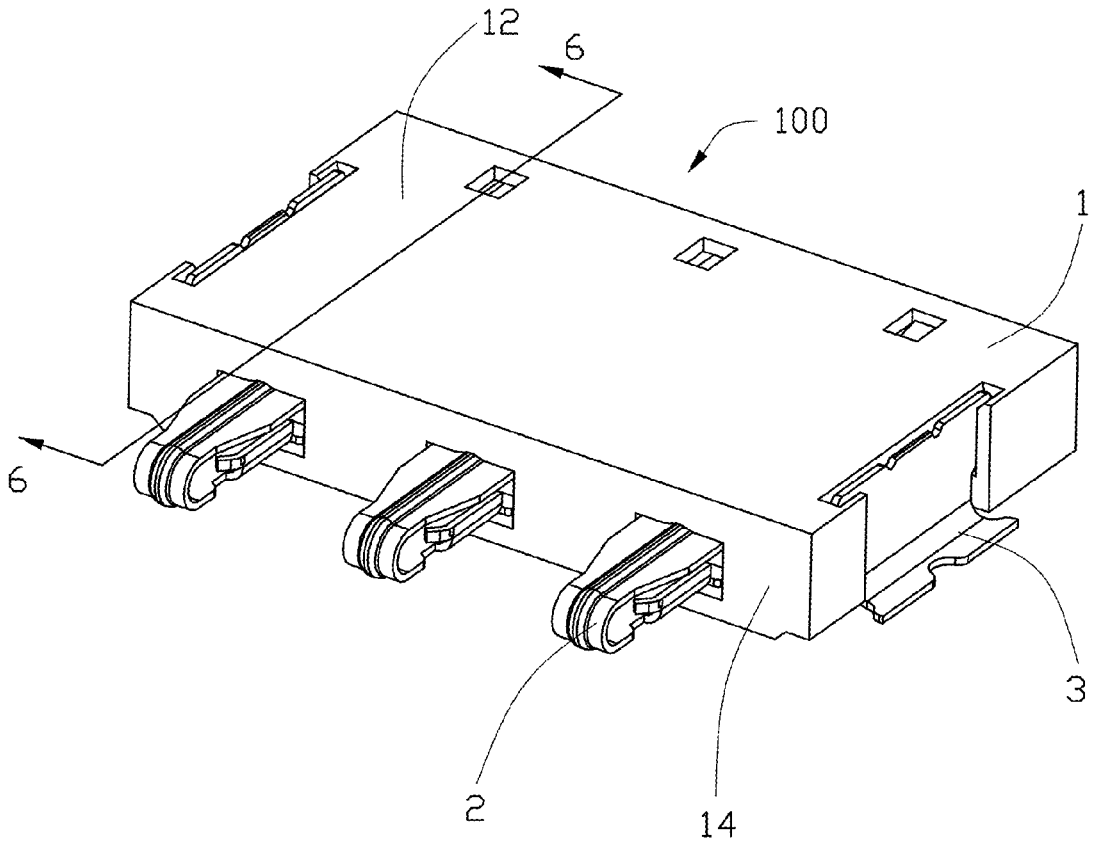
FIG. 1 is a perspective, assembled view of a power connector of the present invention.

Reference will now be made in detail to the preferred embodiment of the present invention.

Referring to FIGS. 1 to 7, a power connector comprises an insulative housing 1, a plurality of contacts 2 accommodated in the insulative housing 1 and a pair of fixed element 3. The insulative housing 1 comprises an upper surface 12, a lower surface 13, a front surface 14 connecting the upper surface 12 and the lower surface 13, a receiving space 10 and a fixed groove 11.

Figure 2:
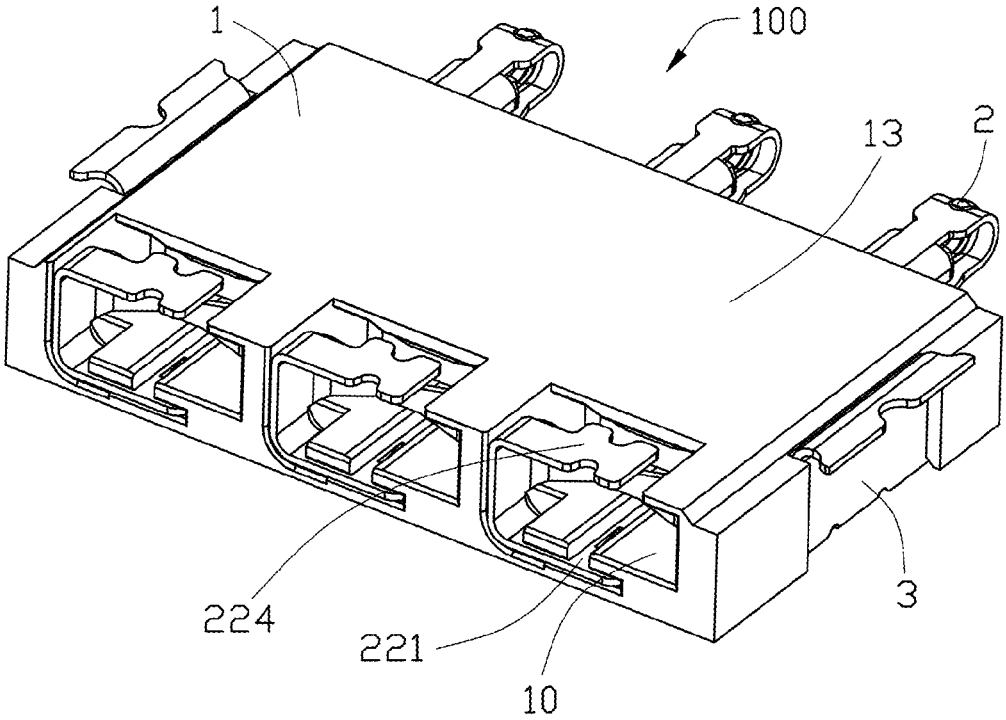
FIG. 2 is another perspective, assembled view of the power connector, taken from a different view with respect to FIG. 1.
Figure 3:
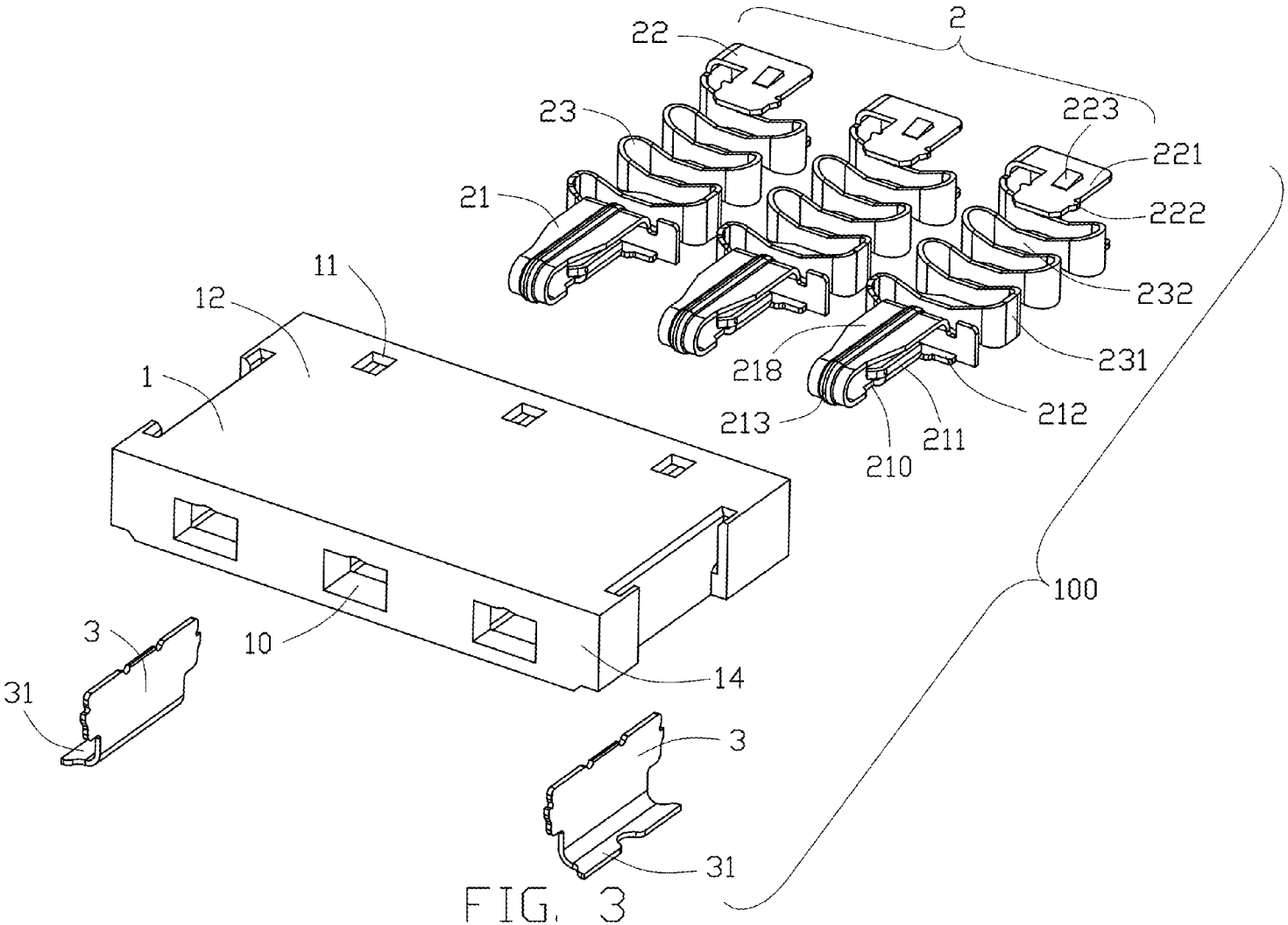
FIG. 3 is a perspective, exploded view of the power connector shown in FIG. 1.
Figure 4:
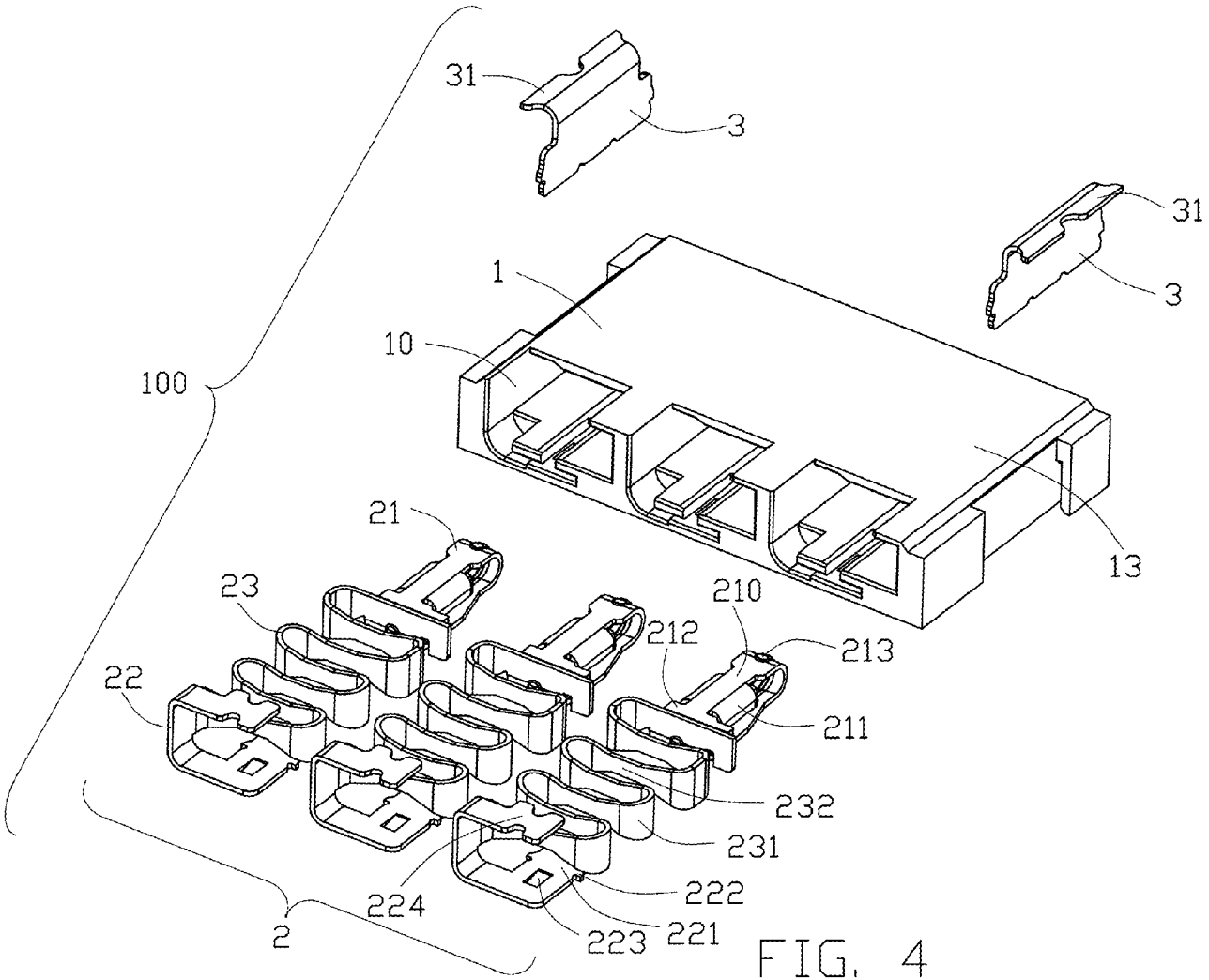
FIG. 4 is another perspective, exploded view of the power connector, taken from a different view with respect to FIG. 3.
Figure 5:
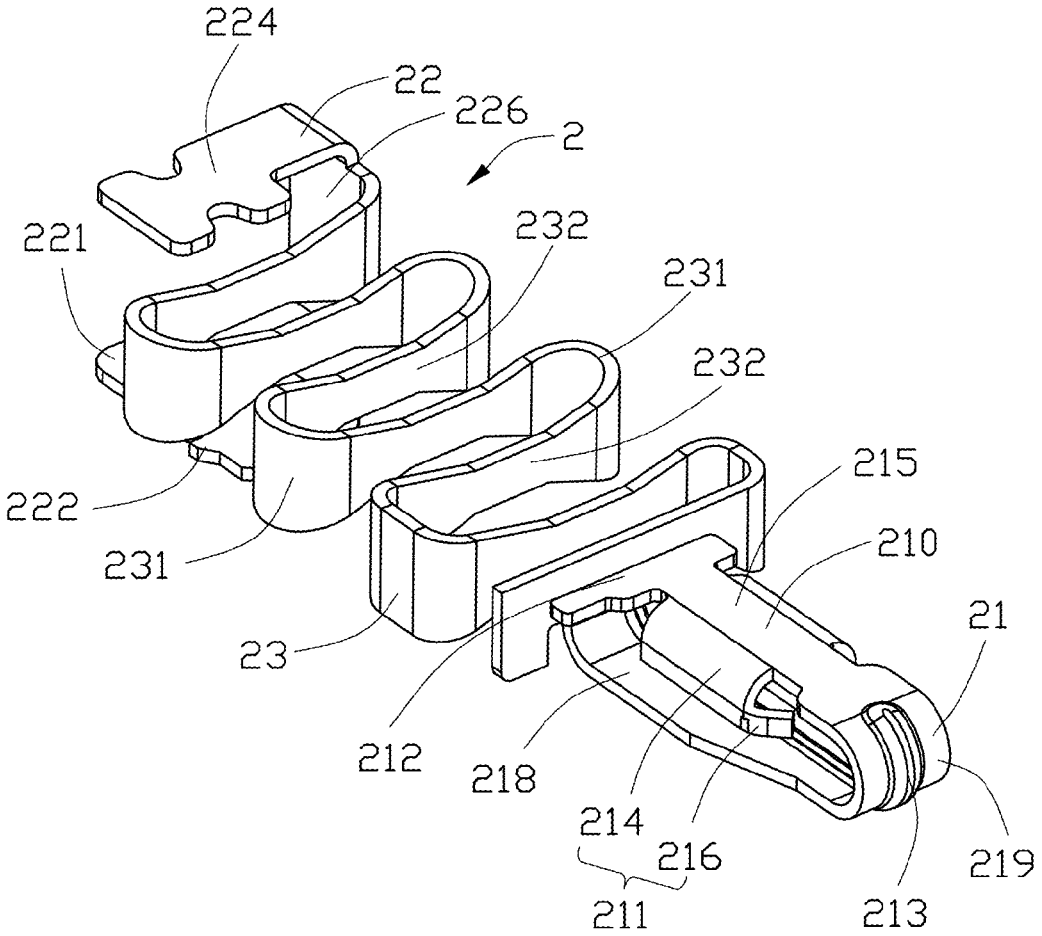
FIG. 5 is a perspective, assembled view of the contact of the power connector shown in FIG. 4.
Figure 6:
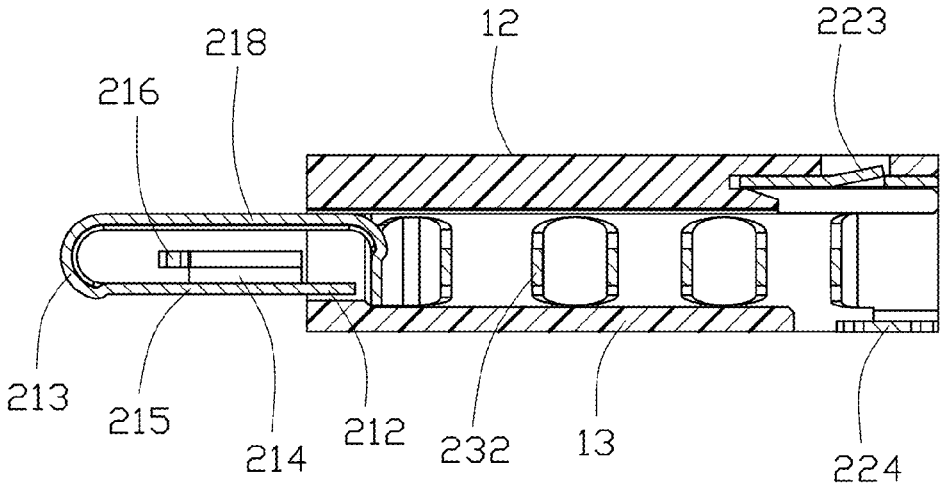
FIG. 6 is a cross-sectional view of the power connector of FIG. 1.
Figure 7:
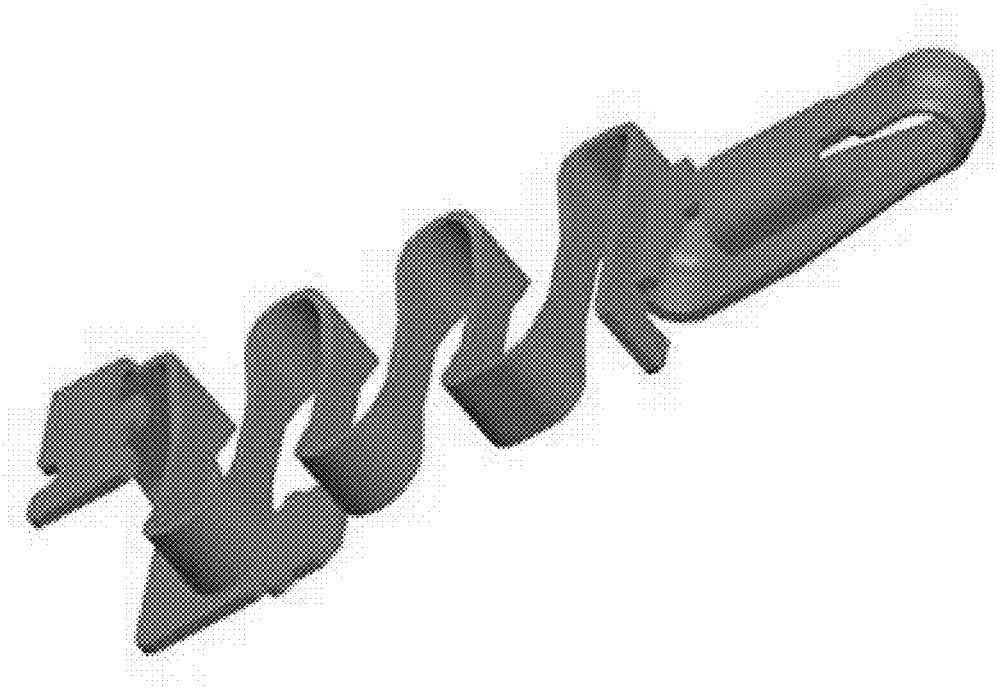
FIG. 7 is another perspective, assembled view of the contact of the power connector shown in FIG. 4.

Referring to FIGS. 1 to 2, the contacts 2 are accommodated in the receiving space 10 of the insulative housing 1. Referring to FIGS. 3 to 5, the contact 2 comprises a (front) contacting portion 21 reaching out of the front surface 14 of the insulative housing 1 for connecting with a corresponding connector (not shown), a rear (mounting) portion 22 accommodated in a rear end of the insulative housing 1 and a snakelike elastic portion 23 connecting the contacting portion 21 and the rear portion 22. The snakelike/serpentine elastic portion 23 and the rear portion 22 are accommodated in the receiving space 10. The fixed elements 3 are accommodated to two sides of the insulative housing 1, and comprise fixed sections 31.

The snakelike elastic portion 23 comprises a plurality of retrorse bending elements looking like U shape. The snakelike portion 23 comprises a plurality of vertical bending sections 231 and a plurality of connecting sections 232 connecting two adjacent bending sections 231. The vertical dimension of the intersecting surface of the bending section 231 is greater than the vertical dimension of the intersecting surface of the connecting section 232.

The contacting portion 21 comprises an upper tongue plate 218 extending forwardly from a top edge of the foremost connecting section 232, a lower tongue plate 210 parallel to the upper tongue plate 218, a reversing section 219 connecting the upper tongue plate 218 and the lower tongue plate 210 and a bulging section 213 bulging from the middle of the upper tongue plate 218 and the reversing section 219. The bulging section 213 is connected with the corresponding connector electrically. The lower tongue plate 210 comprises a base section 215 extending along a fore-and-aft direction from the reversing section 219, a resisting section 212 extending along a left-to-right direction from a rear end of the base section 215 and a pair of enhancing sections 211 bent along a left-to-right direction and downward direction from the middle of the base section 215. The enhancing section 211 comprises a main part 214 extending from the base section 215 and a tail 216 extending forwardly from a part of a front edge of the main part 214. The base section 215 is parallel to the lower tongue plate 210. The resisting section 212 is perpendicular to the base section 215.

The rear portion 22 comprises a vertical middle section 226 extending backwardly from the snakelike elastic portion 23, a holding section 221 bent along a horizontal direction from a top edge of the middle section 226 and a soldering section 224 bent along a direction parallel to the holding section 221 from a lower edge of the middle section 226. The holding section 221 comprises a plurality of barbs 222 located in two sides of the holding section 221 and a stop element 223 coordinating with the fixed groove 11. The stop element 223 is a bulge plate formed on a top surface of the holding section 221. The holding section 221 and the soldering section 224 are adjacent to the upper surface 12 and the lower surface 13 respectively. The soldering section 224 is exposed in the rear end of the receiving space 10 for connecting with a printed circuit board (not shown) electrically.

Referring to FIGS. 1 to 5, the contacting portion 21 is bent along a direction perpendicular to a horizontal direction of the upper surface 12 of the insulative housing 1. The snakelike elastic portion 23 is bent along a direction parallel with the horizontal direction of the upper surface 12 of the insulative housing 1.

When the power connector is connected with the corresponding connector, the bulging section 213 resists against the corresponding connector, the contacting portion 21 is deformed with the pressing force and the snakelike elastic portion 23 has a compressive deformation in the receiving space 10. Under an excessively large compression force, the resisting portion 212 of the lower tongue plate 210 may resist against the connecting section 232 connecting the snakelike elastic portion 23 and the contacting portion 21 to have the contacting portion 21 contact the elastic portion 23 for preventing the contacting portion 21 from being improperly deformed furthermore. The enhancing sections 211 enhance the strength of the lower tongue plate 210 in a vertical direction for preventing the lower tongue plate 210 to be deformed.

That the snakelike elastic portion 23 is bent along a direction parallel with the horizontal direction of the upper surface 12 of the insulative housing 1, can reduce the height of the power connector 100. That the vertical dimension of the intersecting surface of the bending sections 231 is greater than the vertical dimension of the intersecting surface of the connecting sections 232, can enhance the strength of the snakelike elastic portion 23 and increase the service life of the power connector 100. That the barbs 222 are let into the insulative housing 1 and the stop element 223 is accommodated in the groove 11, for preventing the contacts 2 from being deviated away from the insulative housing 1.

Figure 8:
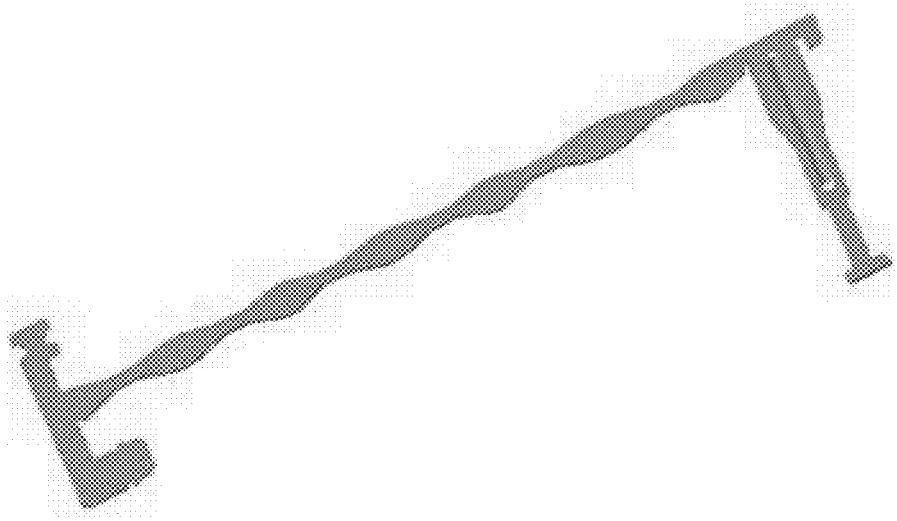
FIG. 8 is a plan view of the contact in an extended manner before being formed with the final configuration.

Generally speaking, the contact 2 forms a front contacting section 21, a rear mounting section 22 and a serpentine elastic section 23 linked therebetween. The front contacting section 21 defines a first U-shaped structure with two first legs and a first transverse bight linked therebetween, wherein each first leg extends along the front-to-back direction and the first bight extends in the vertical direction perpendicular to the front-to-back direction. Differently, the rear mounting section 22 defines a second U-shaped structure with two second legs and a second transverse bight linked therebetween, wherein each second leg extends in the transverse direction perpendicular to both the front-to-back direction and the vertical direction, and the second bight extends in the front-to-back direction. Because of the structure, in an extended manner before forming its final configuration, the rear mounting section 22 is connected to a rear end of the serpentine elastic section 23 and extends in roughly a symmetrical way while the front contacting section 21 is connected to the side around a front end of the serpentine elastic section 23 and extends in a asymmetrical way. On the other hand, as shown in FIG. 8 the rear end of the serpentine elastic section 23 is linked to the second bight of the rear mounting section 22 while the front end of the serpentine elastic section 23 is linked to one first leg of the front contacting section 21. Under this structure, one second leg is the holding section 221, and the other second leg is the soldering section 224; one first leg is linked to the serpentine elastic section 23 for deforming the serpentine elastic section 23 and the other first leg to form the resisting section 212 for further abutting against the serpentine elastic section 23 when the front contacting section 21 experiences an uneven force during mating.

What is claimed is:

1. A power connector comprising:

an insulative housing comprising an upper surface, a lower surface, and a receiving space;

a plurality of contacts accommodated in the insulative housing, each contact comprising a contacting portion, a rear portion accommodated in a rear end of the insulative housing, and a snakelike elastic portion connecting the contacting portion and the rear portion, the snakelike elastic portion comprising a plurality of vertical bending sections and a plurality of connecting sections each connecting every two adjacent bending sections;

wherein a vertical dimension of the bending section is greater than a vertical dimension of the connecting section;

wherein the contacting portion comprises an upper tongue plate extending forwardly from one of the connecting sections, a lower tongue plate parallel to the upper tongue plate, and a reversing section connecting the upper tongue plate and the lower tongue plate;

wherein the lower tongue plate comprises a base section extending along a fore-and-aft direction from the reversing section; and wherein the lower tongue plate further comprises a pair of enhancing sections bent along a left-to-right direction and a downward direction from the base section.

2. The power connector as claimed in claim 1, wherein the contacting portion is bent along a direction perpendicular to a horizontal direction of the upper surface of the insulative housing.

3. The power connector as claimed in claim 1, wherein the snakelike elastic portion is bent along a direction parallel with a horizontal direction of the upper surface of the insulative housing.

4. The power connector as claimed in claim 1, wherein the contacting portion further comprises a bulging section bulging from a middle of the upper tongue plate and the reversing section.

5. The power connector as claimed in claim 1, wherein the lower tongue plate further comprises a resisting section extending along the left-to-right direction from a rear end of the base section.

6. The power connector as claimed in claim 1, wherein the contacting portion reaches out of the front surface of the insulative housing.

7. The power connector as claimed in claim 1, wherein the rear portion comprises a vertical middle section extending backwardly from the snakelike elastic portion, a holding section, and a soldering section bent along a horizontal direction from two sides of the middle section respectively.

8. The power connector as claimed in claim 7, wherein the holding section comprises a plurality of barbs at two sides thereof.

9. The power connector as claimed in claim 7, wherein the insulative housing has a fixed groove, and the holding section has a stop element cooperating with the fixed groove.

10. A power connector comprising:

an insulative housing comprising an upper surface, a lower surface, and a receiving space;

a plurality of contacts accommodated in the insulative housing, each contact comprising a contacting portion, a rear portion accommodated in a rear end of the insulative housing, and a snakelike elastic portion connecting the contacting portion and the rear portion, the contacting portion comprising an upper tongue plate extending forwardly from the snakelike elastic portion, a lower tongue plate parallel to the upper tongue plate, and a reversing section connecting the upper tongue plate and the lower tongue plate;

wherein the lower tongue plate comprises a base section extending along a fore-and-aft direction from the reversing section and a pair of enhancing sections bent along a left-to-right direction and a downward direction from the base section.

11. The power connector as claimed in claim 10, wherein the base section further comprises a resisting section extending along a left-to-right direction from a rear end of the base section.

12. The power connector as claimed in claim 10, wherein the snakelike elastic portion comprises a plurality of vertical bending sections and a plurality of connecting sections each connecting every two adjacent bending sections.

13. The power connector as claimed in claim 12, wherein the contacting portion defines a bending direction perpendicular to a horizontal direction of the upper surface of the insulative housing, and the snakelike elastic portion defines a bending direction parallel to the horizontal direction of the upper surface of the insulative housing.

14. A power connector comprising:

an insulative housing defining opposite upper and lower surfaces in a vertical direction, a plurality of receiving spaces between said upper and lower surfaces and side by side arranged with one another in a transverse direction perpendicular to said vertical direction, each of said receiving spaces extending along a front-to-back direction perpendicular to both said vertical direction and said transverse direction;

a plurality of contacts disposed in the corresponding receiving spaces, respectively, each of said contacts including a front contacting section, a rear mounting section, and a serpentine elastic section located therebetween and deformable along said front-to-back direction;

said front contacting section defining a first U-shaped structure with a pair of first legs and a first bight linked therebetween wherein each of said first legs extends along the front-to-back direction while said first bight extends in the transverse direction;

said rear mounting section defining a second U-shaped structure with a pair of second legs and a second bight linked therebetween wherein each of said second legs extends along the transverse direction while said second bight extends in the vertical direction;

wherein one of said pair of first legs is linked to the serpentine elastic section while the other of said pair of first legs is spaced from the serpentine elastic section, the other first leg being able to contact the serpentine elastic section when an excessive force is applied to the front contacting section to prevent the front contacting section from over-deforming.

15. The power connector as claimed in claim 14, wherein one of said pair of second legs is retained to the housing while the other of said pair of second legs is exposed to an exterior around said lower surface for soldering to a printed circuit board.

16. The power connector as claimed in claim 14, wherein the other of said pair of first legs is located closer to the lower surface than to the upper surface.

* * * * *